US006120372A

United States Patent [19]

Riello

[11] Patent Number: 6,120,372

[45] Date of Patent: Sep. 19, 2000

[54] FAN CONVECTOR WITH ADJUSTABLE DEFLECTOR ELEMENTS

[75] Inventor: Valerio Giordano Riello, Verona, Italy

[73] Assignee: Riello Condizionatori S.P.A., Verona, Italy

[21] Appl. No.: 08/951,051

[22] Filed: Oct. 15, 1997

[30] Foreign Application Priority Data

Oct. 15, 1996 [EP] European Pat. Off. ..... 96830527

[51] Int. Cl.[7] ..... F24F 3/044

[52] U.S. Cl. ..... 454/233; 454/256; 454/318; 454/321

[58] Field of Search ..... 454/229, 233, 454/256, 319, 320, 321, 318, 325; 236/49.3

[56] References Cited

U.S. PATENT DOCUMENTS 2,808,237 10/1957 Fosnes ..... 454/233 X
4,615,481 10/1986 Tanaami et al. .
5,234,373 8/1993 Yamazaki et al. ..... 454/318 X
5,338,251 8/1994 Matsumoto ..... 454/153
5,788,570 8/1998 Cho ..... 454/233

FOREIGN PATENT DOCUMENTS

0560037A1 1/1993 European Pat. Off. .
0657701A2 12/1994 European Pat. Off. .

*Primary Examiner*—Harold Joyce
*Attorney, Agent, or Firm*—Nixon & Vanderhye PC

[57] ABSTRACT

A fan convector for heating air enclosed environments, comprising a fan, an intake opening with an air filter, a heat-exchanger for heating the air, and an air outlet; the fan is driven by a first electric motor which is controlled by a thermostat for switching it on/off, the fan convector also comprising a set of elements for deflecting the air flow through the air outlet, the elements being orientable on an axle moved angularly by a second electric motor to a plurality of positions between a closed position and a fully-open position, and the second electric motor being controlled by the thermostat.

4 Claims, 3 Drawing Sheets

FAN CONVECTOR WITH ADJUSTABLE DEFLECTOR ELEMENTS

TECHNICAL FIELD

The present invention relates to a fan convector for heating air in enclosed environments, comprising a fan, an intake opening with an air filter, a heat-exchanger for heating the air, and an air outlet, the fan being driven by a first electric motor which is controlled by a thermostat for switching it on/off.

BACKGROUND OF THE INVENTION

A fan convector is a device which can condition air in enclosed spaces by heating it. Generally, it comprises a fan unit which draws the air from the environment, conveying it through a cleaning filter and a heat exchanger.

The ambient temperature is monitored by means of a suitable thermostat associated with a device for adjusting the ventilation. When the ambient temperature exceeds the value set by a certain amount the fan unit stops to allow the temperature to return to the desired value. During this stage, however, even in the absence of forced ventilation, an air-flow is created through the heat-exchanger due to natural convection. This occurs since the air which is close to the surfaces of the heat exchanger is inevitably heated and thus tends to rise. The continuous upward movement of portions of air creates a natural flow through the fan convector. The fan convector thus continues to supply hot air in an uncontrollable manner, causing the ambient temperature to change, contrary to the requirements of the thermostat.

A need is therefore created for the provision of a fan convector which, by virtue of its structural characteristics, can control these natural convection currents and which can therefore achieve a precise regulation of the ambient temperature in enclosed spaces.

SUMMARY OF THE INVENTION

The problem is solved by a fan convector for heating air in enclosed environments comprising a fan, an intake opening with an air filter, a heat-exchanger for heating the air, and an air outlet, the fan being driven by a first electric motor which is controlled by a thermostat for switching it on/off, characterized in that the air outlet has a set of air-flow deflection elements which are orientable on a shaft moved angularly by a second electric motor to a plurality of positions between a closed position and a fully-open position, the second electric motor being controlled by the thermostat.

The fan convector according to the invention advantageously comprises a knurled knob having a camshaped peripheral portion for alternative manual orientation of the deflector elements between a closed position and an open position.

A further aspect of the present invention provides for the knurled knob to come into contact with a switch, switching on or off a device for switching on/off the first motor for driving the fan.

In an alternative embodiment of the present invention, the first motor for driving the fan is switched off or on, independently of the thermostat, by means of the device for switching it on/off.

The fan convector according to the present invention has the considerable advantage of being able to regulate the ambient temperature of enclosed spaces extremely precisely since it can stop the hot-air current generated by natural convection. The fan convector according to the present invention is also advantageous from the point of view of energy consumption and hence from an ecological point of view, since it is possible, with the assistance of the hot-air convection current, to approach the temperature value set without the need to use electrical energy to operate the fan from the outset.

BRIEF DESCRIPTION OF THE DRAWINGS

For a better understanding of the invention, a preferred embodiment thereof will now be described by way of non-limiting example, and is shown in the appended drawings, in which.

DETAILED DESCRIPTION OF THE PREFERRED EMBODIMENT

Figure 1:
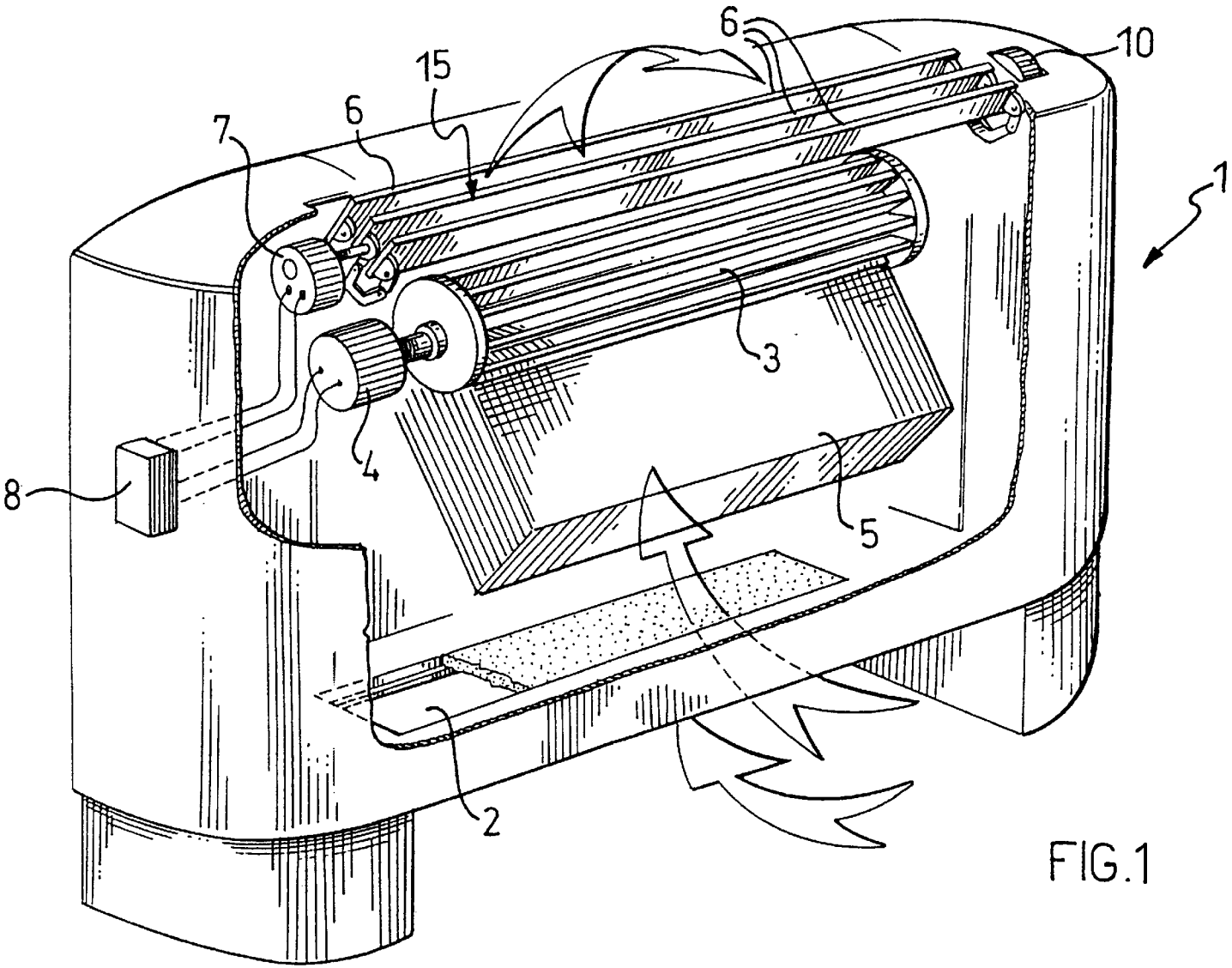
FIG. 1 is a partially-sectioned perspective view of a fan convector according to the invention.

With reference to FIG. 1, the fan convector, generally indicated 1, comprises an intake opening 2 with a filter; air is drawn through the opening from the surrounding environment by means of a fan 3 driven by a first electric motor 4. The air drawn in is then brought into contact with a heat-exchanger 5 comprising a coil (not shown) through which a hot fluid flows. The fluid is preferably but not necessarily water.

The air drawn from the environment is thus heated, conveyed upwards, and expelled through an air outlet 15 of the fan convector through a set of air-flow deflection elements 6 which can be oriented and driven by a second electric motor 7 to a series of positions between a closed position and a fully-open position. The second motor 7 for driving the deflector elements 6, like the connection or disconnection of the first electric motor 4 of the fan 3, is controlled by a thermostat 8 operating in wholly conventional manner.

Figure 2:
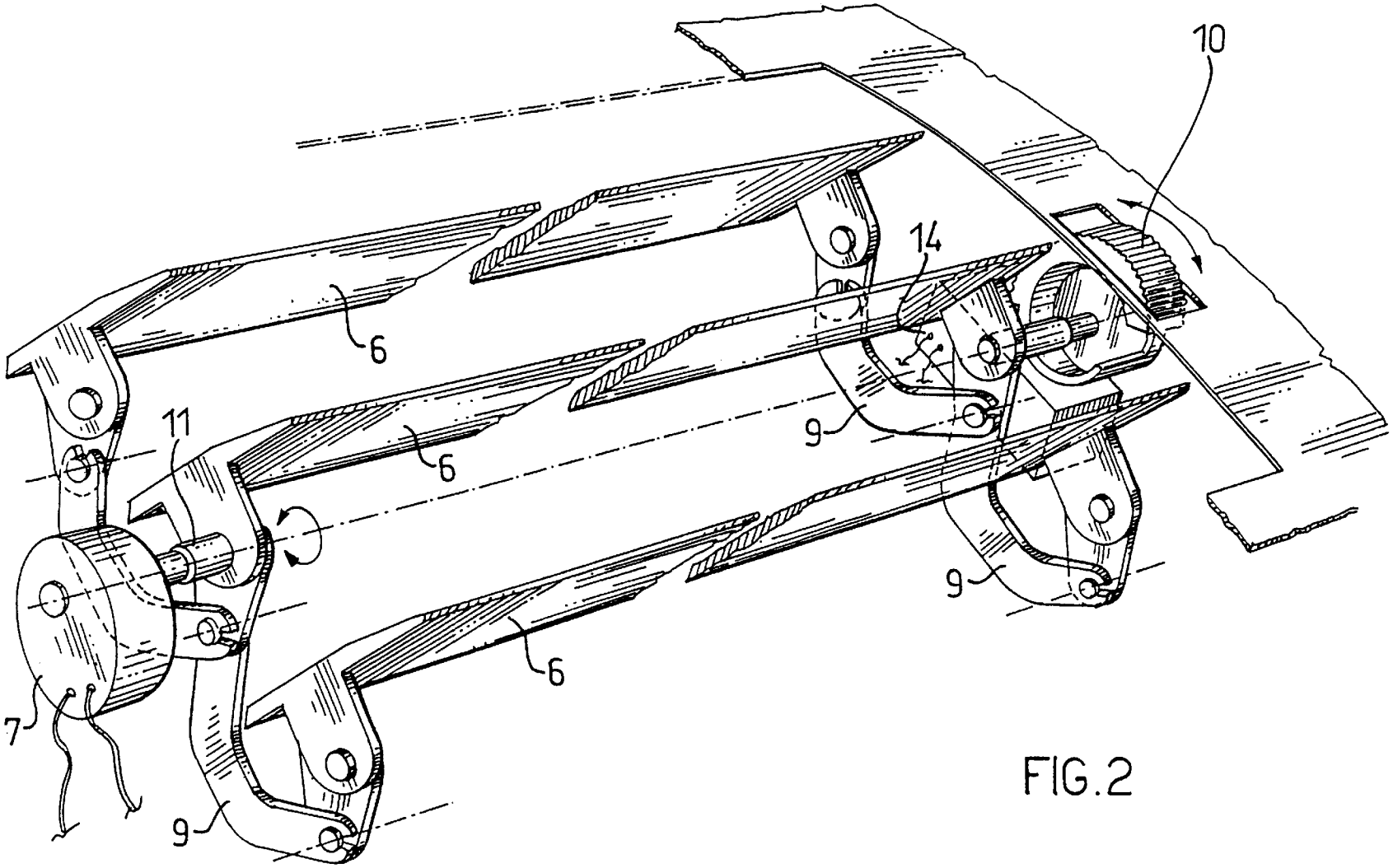
FIG. 2 is a detail of FIG. 1 showing the set of adjustable deflector elements positioned on the upper portion of the fan convector of FIG. 1, and FIG. 3 and FIG. 4 are sections showing the device for the manual adjustment of the deflector elements of the fan convector according to the invention.

With reference to FIG. 2, the ends of the deflector elements 6 are hinged on articulated connection levers 9 fixed for rotation with drive means 11 operated both by the second motor 7 and by a knurled knob 10 having a cam-profiled peripheral portion for the manual opening and closure of the deflector elements 6.

Figure 3:
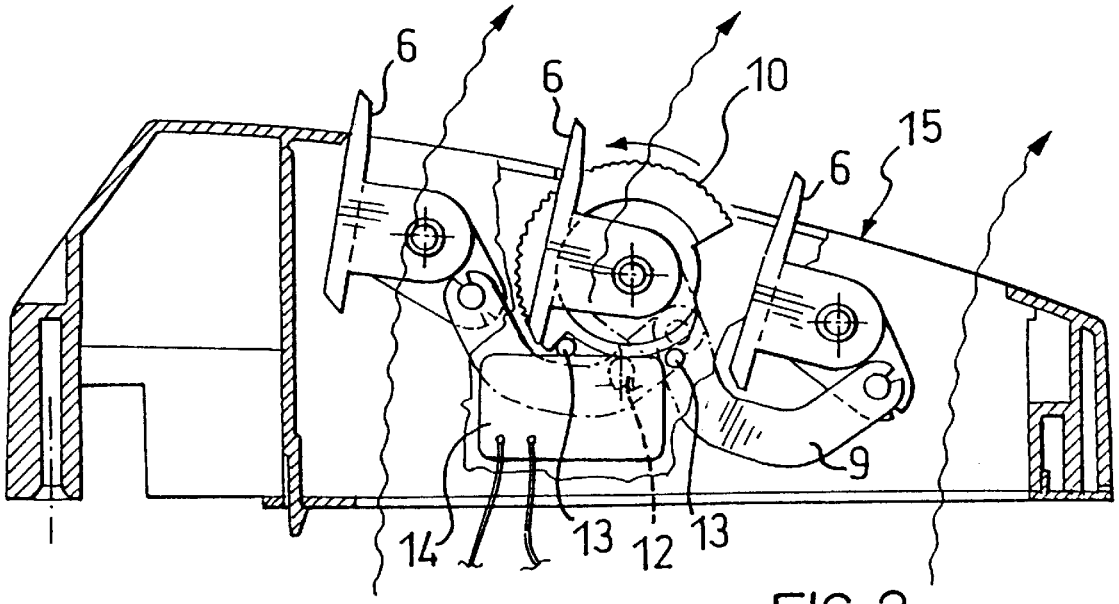
Figure 4:
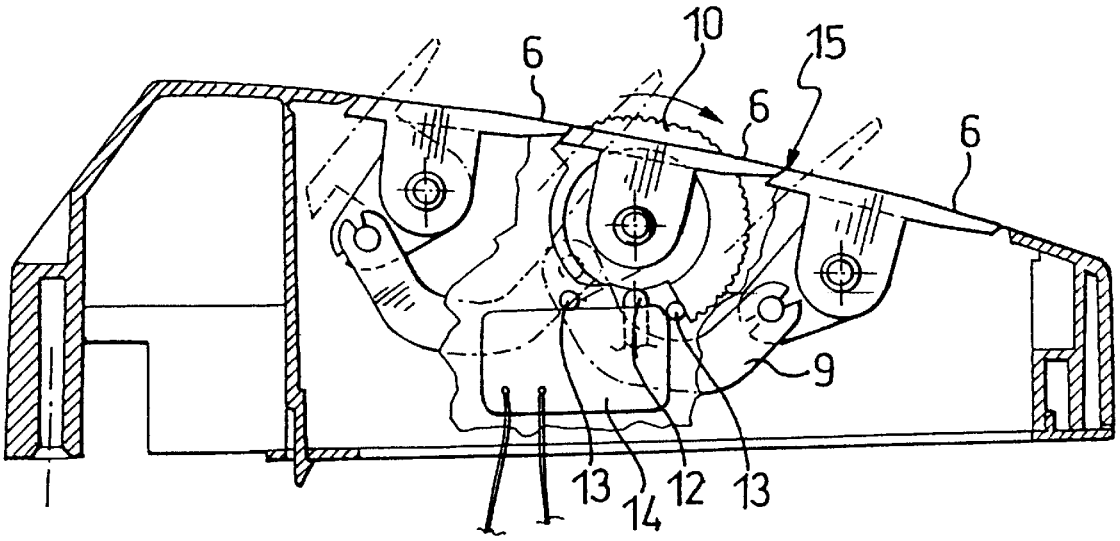

With reference to FIGS. 3 and 4, the knurled knob 10 can rotate clockwise or anticlockwise through a fraction of a round angle defined by two stop pins 13 and by the cam profile of the knob. The cam profile can come into contact with a switch 12 which, by means of the on/off switching device 14, can switch off the electric circuit which supplies the fan 3 (FIG. 1) of the fan convector.

The operation of the fan convector just defined structurally will now be described.

With reference once again to FIG. 1, when the ambient temperature of a room provided with the convector heater described above falls below a certain predetermined value T1, the thermostat 8 opens the deflector elements and switches on the first motor 4 of the fan 3 and air is drawn in through the opening 2, conveyed through the heat exchanger 5 and made to flow into the environment again through the deflector elements 6. The ambient temperature thus increases until the predetermined temperature T1 is reached when the thermostat 8 stops the fan 3 again, by switching off the first motor 4. As a result of the natural convection already mentioned, the ambient temperature will nevertheless tend to rise and, when a certain value T2, also predetermined and set in the thermostat 8, is reached, the thermostat will switch on the motor 7. The deflector elements 6 which, up to now, were in the open position, are oriented progressively so as to close until the air-flow created by the natural convection is completely blocked. The thermostat 8 thus adjusts the operation of the second motor 7 and hence orients the deflector elements, putting them in a position such as to regulate, if not actually to interrupt, the flow of hot air output from the fan convector, in dependence on the prevailing ambient temperature. When the ambient temperature reaches and falls below the value T1, the thermostat 8 first restarts the second motor 7, opening the deflector elements 6 and causing the flow of hot air due to natural convection to start again, and then switches on the first motor 4 so that the fan 3 starts to operate again.

In the embodiment just described, the hot air-flow can also be interrupted at will.

In fact, the knurled knob 10 (FIGS. 3 and 4) positioned at the opposite end to the second electric motor 7 for driving the deflector elements, enables the latter to be oriented manually if the user wishes to interrupt immediately the flow of hot air output from the fan convector.

If the fan convector is in full operation and the deflector elements are therefore fully open, the flow can be interrupted and the fan switched off by clockwise rotation of the knurled knob 10 (which is at its travel limit (FIG. 3). During the first stage of the rotation, the switch 12 is pushed down by the cam profile of the knurled knob 10, maintaining the electrical contact for the supply of the fan. When the first portion of the cam profile of the knurled knob 10 has passed over it, that is, when the deflector elements have reached a certain degree of closure, the switch 12 loses contact with the cam profile and, as it is released, switches off the supply circuit of the fan. This ensures that the fan is switched off independently of the thermostat 8 when the deflector elements are closed or semi-closed. The fan 3 can be switched on again by rotation of the knob 10 in the opposite sense; upon completion of the first stage of rotation and when the critical degree of opening of the deflector elements has been reached, the switch 12 will thus switch the supply circuit of the fan on again.

The structural and operating characteristics of the device according to the invention have been described for the heating of air; however, the device according to the invention can also be used as an air conditioner although, in this case, the effect caused by natural convection is negligible.

A person skilled in the art will be able to apply many modifications and variations to the fan convector described above in order to satisfy further and contingent requirements without thereby departing from the scope of the invention.

What is claimed is:

1. A fan convector for heating air in enclosed environments comprising a fan, an intake opening with an air filter, a heat-exchanger for heating the air, and an air outlet, the fan being driven by a first electric motor which is controlled by a thermostat for switching the fan on/off, in response to a temperature T1, wherein the air outlet has a set air-flow deflection elements which are orientable on a shaft moved angularly by a second electric motor to a plurality of positions between a closed position and a fully-open position, the second electric motor being controlled by the thermostat in response to a temperature T2.

2. A fan convector according to claim 1, further comprising a knurled knob having a cam-shaped peripheral portion for the alternative manual orientation of the deflector elements between a closed position and an open position.

3. A fan convector according to claim 2, wherein the camshaped portion of the knurled knob comes into contact with a switch switching on or off a device for switching on/off the first motor for driving the fan.

4. A fan convector according to claim 3, wherein the first motor for driving the fan is switched off or on independently of the thermostat by means of the device for switching it on/off.

* * * * *